United States Patent [19]

Harvey

[11] Patent Number: 4,606,720

[45] Date of Patent: Aug. 19, 1986

[54] PRE-VAPORIZING LIQUID FUEL BURNER

[75] Inventor: Andrew C. Harvey, Waltham, Mass.

[73] Assignee: Foster-Miller, Inc., Waltham, Mass.

[21] Appl. No.: 651,172

[22] Filed: Sep. 17, 1984

[51] Int. Cl.[4] ..... F23J 5/02

[52] U.S. Cl. ..... 431/115; 431/347

[58] Field of Search ..... 431/115, 116, 351, 9

[56] References Cited

U.S. PATENT DOCUMENTS 3,238,994 3/1966 Kirk ..... 431/350

FOREIGN PATENT DOCUMENTS 47811 11/1978 U.S.S.R. ..... 431/351

OTHER PUBLICATIONS

A Low Input Variable Firing Rate Oil-Fired Burner by Charles F. Mariano, Sep. 30, 1981, Prepared by Foster-Miller Associates, Inc., 350 2nd Ave., Waltham, MA 02154, Dept. of Energy Publication.

*Primary Examiner*—Carroll B. Dority, Jr.

*Attorney, Agent, or Firm*—Herbert L. Bello

[57] ABSTRACT

A pre-vaporizing liquid fuel burner with an eductor mounted to the end of a burner housing having an internal chamber. The eductor has air ducts disposed in a throat of the eductor through which combustion gas and air flow. A perforated flameholder is contiguous with the gas inlet of the eductor throat. The air flowing from the ducts creates a suction at the downstream side of the eductor throat which, in turn, draws the combustion gas from the center of the flame into the throat. The streams of air and gas flow from the eductor in interleaving streams to a mixing zone and then to the chamber downstream of the eductor. The interleaving streams are non-parallel to the burner axis but flow in an axisymmetric pattern to produce turbulent secondary eddies or flow patterns for complete mixing of air and combustion gas in a short distance. Liquid fuel is sprayed into the axisymmetric flow of the air-gas mixture where it evaporates. The combined air-gas-fuel vapor mixture is then fed to the flameholder and ignited.

9 Claims, 3 Drawing Figures

52
56
37
24
39
36
37
10
2
44
54
3
44
50
12
14
52
56
38
18
37
36
32
25
28
29
27
20
34
30
22
16
46
39
2
40
3
26

PRE-VAPORIZING LIQUID FUEL BURNER

BACKGROUND OF THE INVENTION

1. Field of the Invention

The present invention relates to burners and, more particularly, is directed towards pre-vaporization liquid fuel burners.

2. Description of the Prior Art

Oil fired burners are well known in the art. Gun type oil burners are characterized by a flame which is large, poorly mixed and highly turbulent, the flame being produced by direct spraying of fuel oil into air. U.S. Pat. No. 3,738,532 discloses an oil gasification burner in which oil is sprayed into a preheated mixing chamber and is vaporized to produce a combustible gas. U.S. Pat. No. 3,980,422 shows a liquified fuel burner in which fuel oil is gasified by being mixed with hot burned gases drawn from a combustion chamber, the heat of vaporization of the oil being used to cool the returning gases. U.S. Pat. Nos. 1,597,661; 3,174,526; 3,277,945; 3,399,022; 3,545,902; 3,604,824; 3,620,657; 3,897,199; 3,927,958; 3,994,665; and 4,003,691 disclose burners which utilize recirculated combustion gases, pre-mixing eductors, and flameholders. U.S. Pat. No. 3,632,284 discloses a dual fuel burner having a combustion gas feedback conduit to supply heat for gasification of the fuel oil. Generally, recirculation burners have good performance and very clean combustion, but they are relatively complex in design and costly to manufacture. In addition, such prior art burners have encountered varying degrees of success due to their sensitivity

SUMMARY OF THE INVENTION

An object of the present invention is to provide a prevaporizing liquid fuel burner in which a fully gaseous mixture is prepared separately and before combustion occurs.

Another object of the invention is to provide a prevaporizing burner for liquid fuel wherein the fuel is vaporized by the heat of a precisely controlled mixture of combustion gases and air. The combustion gases, fuel vapors and air mixture are uniformly mixed, before chemically homogeneous combustion occurs on a perforated flameholder surface. The burner is characterized by a housing with an internal chamber. A perforated flameholder and an eductor are mounted at the front end of the chamber and a fuel nozzle is mounted at the back end thereof. The eductor has air ducts through which air flows and a throat through which combustion gas flows. The air flow ducts are disposed in the throat and positioned to direct air toward the longitudinal axis of the chamber in a vortical flow pattern. The air streams flowing out of the ducts create a suction at the downstream side of the throat which draws the combustion gas from the center of the flame into the eductor throat. The flame is supported on the perforated flameholder which is contiguous with the inlet side of the eductor throat. Interleaving streams of air and combustion gas flow from the eductor ducts and throat and are axisymmetrically mixed in a mixing diffuser zone in the internal chamber downstream of the eductor. Fuel is sprayed into the rear of the chamber through the nozzle and mixed with the mixture of combustion gas and air. The combined mixture of fuel vapor, combustion gas, and air is directed to the perforated flameholder for ignition and external combustion.

Other objects of the present invention will in part be obvious and will in part appear hereinafter.

The invention accordingly comprises the apparatus together with its parts, elements, and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figures 1, 2, 3:
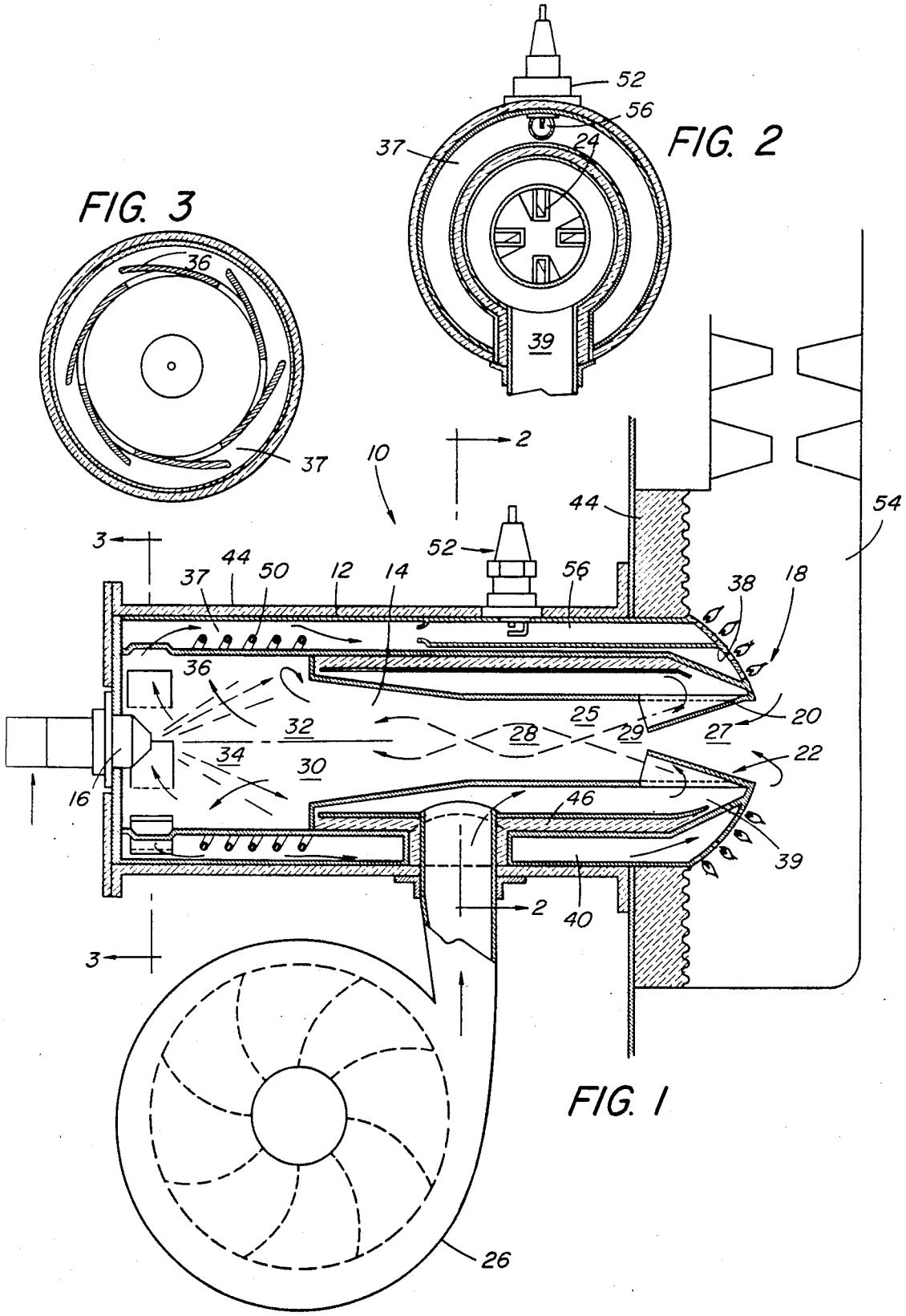
FIG. 1 is a side elevation, somewhat schematic in form, of a fuel burner embodying the present invention.
FIG. 2 is an end view of the burner taken along the line 2—2 of FIG. 1.
FIG. 3 is an end view of the burner taken along the line 3—3 of FIG. 1.

Referring now to the drawings, particularly FIG. 1, there is shown a pre-vaporizing liquid fuel burner 10 embodying the present invention. Burner 10 includes a housing 12 having an internal chamber 14 wherein air is mixed with combustion gas recirculation (CGR) to provide pre-vaporization of fuel, for example oil, which is sprayed into the rear of the chamber through a nozzle 16. CGR from the center of a flame 18 is drawn into a throat 20 of an eductor 22 by the suction created from the rearwardly flowing air streams in ducts 24 in the eductor. Flame 18 is supported on a perforated flameholder 38 which surrounds the inlet side 27 of throat 20. Flameholder 38, on which flame 18 is supported and from which the CGR is drawn into eductor 22, is a screen in the form of a dome-shaped structure having a plurality of holes in the range of 0.01 of an inch to 0.1 of an inch. Air ducts 24, for example four air ducts, all have inwardly tapering sidewalls, the ducts being offset in a somewhat helical path from the longitudinal axis of housing 12. A blower 26 blows air through ducts 24 and into a forward zone 25 of chamber 14. Preferably, the air streams flowing out of ducts 24 in eductor 22 are directed toward the longitudinal axis of chamber 14 in a vortical path. The air streams create a suction at the downstream side or outlet 29 of throat 20 which draws CGR from the center of flame 18 into the mouth 27 of throat 20. The air flowing from ducts 24 and CGR flowing from the outlet 29 of throat 20 exit eductor 22 in substantially interleaving streams.

The interleaving streams of CGR and air are mixed in an intermediate mixing zone 28 in chamber 14, the mixing zone being directly downstream of eductor 22. Downstream of mixing zone 28 are flow deceleration zones 30 and 32. The deceleration zones 30 and 32 are provided to maintain axisymmetric flow of the air and CGR mixture. The mixed CGR and air are directed to the primary fuel vaporization zone 34 which is downstream of, or coexists with deceleration zone 32 at the rear of chamber 14. Fuel from nozzle 16 is sprayed into vaporization zone 34, the nozzle being axisymmetric with the longitudinal axes of chamber 14 and eductor 22. Deflector vanes 36, which are mounted to the rear wall of housing 12 and project into vaporization zone 34, aid in mixing of the fuel, CGR, and air, and direct the mixture through passageways 37 to flameholder 38.

The design of burner 10 is such that the fuel is completely vaporized and well pre-mixed with the air to produce a compact flame tight on the flameholder 38. The combustion gas, which is drawn from the center of the flame 18, provides the necessary heat for pre-vaporization of the fuel. The gas, air, and fuel flow path is compact and short. The various functions of inducting combustion gas from the center of the flame 18, mixing combustion gas with air in order to attain the proper temperature, mixing the proper amount of fuel, providing complete vaporization of fuel, and uniform mixing of this vapor with the air and gases are discussed hereinafter.

The sequence for pre-mixing and pre-vaporizing the fuel with the combustion gas and air mixture begins with the eduction of combustion gas from the center of the flame 18 by the suction created by the air flowing through ducts 24 and out of the outlet 29 of throat 20 in forward zone 25. As previously indicated, the CGR at mouth 27 of throat 20 is surrounded by the flameholder 38. Hence, the flame 18 substantially covers the mouth 27 of the burner 10. In order the prevent significant heat loss from this portion of the flame 18, the radius of mouth 27 is small, about equal to the thickness of the primary flame zone on the surrounding flameholder 38. Thus, the quality and quantity of the CGR is insensitive to the thermally buoyant flows outside of the flame 18 and the chilling effect of a cool furnace wall as long as it is beyond this primary flame zone.

The design of the CGR inlet at the mouth 27 is such that the periphery of the inlet contiguous with the flameholder 38 is kept cool enough so that the flame does not flash back upstream of the flameholder. In addition, the metal contiguous therewith is kept cool in order to avoid either distortion or expensive alloys in fabrication. Cooling of the burner structure surrounding the CGR inlet at the mouth 27 is accomplished by having a conduit 39, which supplies air to eductor 22, contiguous with both the flameholder 38 and the CGR inlet at the mouth 27. Thus, the air conduit 39 that is annular to the CGR inlet at the mouth 27, and ducts 24 provide a cooled wall for guidance of the CGR the short distance to the eductor throat outlet 29. Note that all flows are closely guided and that the CGR is cooled only by the eductor motive air. Accordingly, heat is conserved for fuel vaporization independent of the effectiveness of heat transfer through these internal burner surfaces.

The amount of CGR educted for pre-mixing is precisely controlled to yield the desired final mixed temperature of CGR, air, and fuel vapor at thermodynamic equilibrium. Preferably, the condensation temperature or dew point of the mixed fuel vapor or any fraction thereof is less than the mixture temperature, and less than any wall temperature of a mixture conduit 40 to flameholder 38. Control of CGR and air flows is achieved by adjusting the size and shape of all conduits and ducts so that the motive pressure generated in eductor 22 balances the pressure losses in the rest of the flow path.

On the other hand, the amount of air mixed with the CGR is controlled so that the equilibrium temperature is less than that which will result in rapid spontaneous ignition when the fuel is introduced into the air-CGR mixture. That is, the mixture temperature in the fuel vaporization zone 34 provides an ignition delay time that is long compared to mixture residence time in the burner. These temperature limits of condensation and ignition delay are typically 500° F. and 800° F., respectively, for typical residential fuel use. For reliable, practical application of the concepts of condensation and ignition delay, precise mixing is required in order to avoid local regions that are either too hot or too cold, resulting in either catastrophic pre-ignition or poor uniformity of the flame and long-term build-up of carbonaceous deposits.

As previously indicated, educted CGR and the motive air are brought into initial contact at the outlet 29 side of throat 20 of the eductor 22. The design of throat 20 is such that, in addition to achieving efficient pumping (i.e., high output per given input conditions), the output flow profile of the CGR and air mixture is spatially symmetric and thermodynamically uniform. Otherwise, it would be difficult or practically impossible to avoid the drawbacks of local hot or cold spots and to achieve very uniform combustion of an ideal mixture.

Symmetric, uniform, efficient mixing is initiated in forward zone 25 by the use of an air nozzle shape, or air-CGR boundary wall surface, that effectively subdivides the air and CGR into several substantially discrete and interleaving flow streams. This has the effect of reducing the length of the mixing zone 28 needed to obtain a fairly uniform flow profile. Throat 20 and mixing zone 28 are precisely axisymmetric, and provide the structure which is required to achieve uniform subsequent process functions. In addition to subdividing and interleaving the air and CGR flow streams in zone 25, it is advantageous to direct the flows so that they are not parallel. Preferably, if the air injection flow is subdivided into streams that are not parallel to the general centerline of the mixing zone 28, inclined or skewed or both, then vortical, spiral, or so-called secondary flows are produced. The secondary flows result in complete mixing of air and CGR completely in a short distance of flow. This provides axisymmetric flow into the flow deceleration region zone 30 and precludes the existence of hot streaks of flow downstream where there is contact with the fuel-air mixture and where ignition can occur.

In combination with the mixing zone 28, the design of the flow deceleration zone 30 is such that axisymmetric flow is maintained by limiting the area ratio across this diffuser zone 30 to less than a value of about two, if a diffuser is used at all, followed by an abrupt expansion of flow area in deceleration zone 32, all axisymmetric with the eductor inlet 27, outlet 29, and mixing zones 28. Large ratio of diffuser areas promote asymmetric flow or flow separation. Abrupt or sudden expansions result in axisymmetric recirculation or eddy flow, which is not the case with more gradual transitions between large area ratios.

The air and CGR mixture at the desired temperature flows into the primary fuel vaporization zone 34. Fuel is sprayed or injected into the air and CGR mixture and onto the walls of the chamber with a uniform distribution. One preferred method of fuel injection is with fuel nozzle 16 which is axisymmetric with the longitudinal axis of chamber 14 and eductor 22. The air-gas mixture and fuel are symmetrically distributed and the intensive mixing already existing in the air-gas stream provides satisfactory uniform distribution, near-equilibrium, of the fuel evaporated into the stream. Of course, the fuel vaporization is due to heat supplied directly from contact with the air-CGR stream, as well as heat supplied indirectly from the chamber walls that are heated by the stream.

In the present invention, extensive mixing is accomplished by exchanges of flow-species or packets of flow rapidly across the entire stream. Extensive and intensive mixing provide substantial equilibrium before combustion. The preferred method for obtaining extensive mixing in and downstream of the vaporization zone 34 is to promote swirl flow around the general axis of flow of the air-gas-fuel mixture. Various methods for introducing swirl include skewing of the air streams about the axis of the eductor inlet 27; insertion of vanes 36 to swirl the flow downstream of the vaporization zone 34; insertion of vanes (not shown) in zone 34; and guiding the flow from the vaporization zone 34 to the mixture delivery duct 40 so that there is swirl flow in the delivery duct. In all of the above methods, it is desirable to either subdivide the flow aerodynamically into separate flow streams, or to provide sufficiently high swirl to cause secondary or back-mixing flows of an extensive nature.

Delivery duct 40 provides for optimum combustion and consistency of operation by regulating the flow so that there is sufficient time for the pre-mixture to approach equilibrium and by maintaining the pre-mixture everywhere in the range between its dew point and pre-ignition temperatures. Temperature control in delivery duct 40 is provided by insulating the walls of the duct and preventing heat loss of the pre-mixture either to the surrounding structure and ambient air or to the input of fresh air for combustion. In the preferred embodiment shown in FIG. 1, external insulation 44 is provided by typical light, fibrous matting wrapped around the burner gun-barrel, and internal insulation 46 is provided by impermeable sleeves or doublewall construction limiting direct contact of the fresh air with the hot delivery duct 40.

Induced draft or forced draft and fuel injection can be provided to burner 10 many of the common ways. For example, FIG. 1 shows a directly coupled typical fresh air blower 26 and a nozzle 16 that is supplied with fuel from a tank by a pump through a filter (not shown). Air and fuel supply systems providing variable firing rate or adjustments are compatable with the basic burner 10. The method of using several sequential zones in the chamber 14 for optimum preparation and control of the pre-mixture is especially suitable for use with a variable firing rate because the air-to-CGR ratio, hence mixture temperature, remains substantially constant as the air and fuel flow are varied.

Startup consists of air and fuel flow initiation and control, possibly with pre-heating, and ignition. A nominally rich mixture may be ignited without pre-heating as a result of vaporization of light ends of fuel, in which case CGR causes very rapid heatup to near steady state conditions. In order to ensure ignition under the worst ambient conditions, as well as to minimize transient formation of combustion products that may form deposits in the long term, it is advantageous to preheat the internal structure of burner 10, particularly the vaporization zone 34 in chamber 14 and adjacent conduits. This is accomplished by the use of an electric heating coil 50 shown in FIG. 1, for example. With pre-heated walls, the air-gas stream instantly reaches the desired temperature upon ignition of the pre-mixture and generation of CGR. FIG. 1 shows a spark plug 52 mounted in the burner gun-barrel outside of the furnace 54 and a flame tube 56 from the spark to the main flameholder 38, internal to the delivery duct 40. Thus, ignition migrates or is thrown from the spark to the steady flame zone. In an alternative embodiment, a spark conductor is inserted in burner 10 and extends to a hole in the flameholder 38; or if the forward velocity in the delivery duct 40 is high enough to carry the flame front to the flameholder 38, then ignition can be anywhere in this duct.

Shutdown of the burner is typically on demand of the heating system or necessary because of malfunction of the burner. The latter is conveniently signaled by a temperature sensor (not shown) within the body of the burner itself or, as is more usual but difficult, sensing the flame itself.

As will be seen, ancillary functions and various design features do not specifically limit the novel basic design concept just described for a liquid fuel, premixed, pre-vaporizing burner having superior performance. Since certain changes may be made in the foregoing disclosure without departing from the scope of the invention herein involved it is intended that all matter contained in the above description and depicted in the accompanying drawings be construed in an illustrative and not in a limiting sense.

What is claimed is:

1. A burner comprising:

(a) a housing formed with an internal chamber;

(b) eductor means mounted to said housing at a forward end of said chamber, said eductor means formed with a passageway having an inlet and an outlet, a plurality of air ducts disposed within said passageway, said air ducts arranged to direct air flowing therein into a path toward the longitudinal axis of said chamber from said forward end of said chamber to a rear end thereof;

(c) first means for introducing air into said chamber through said air ducts, recirculated combustion gas being drawn into said eductor means inlet, through said passageway and out said eductor means outlet by air flowing through said ducts, said gas and air entering said chamber in interleaving streams of gas and air, said gas and air mixing in said chamber;

(d) second means for introducing fuel into the rear of said chamber in the flow path of said streams of gas and air, said fuel mixing with said mixture of combustion gas and air in the rear portion of said chamber to form a mixture of combustion gas, fuel, and air; and (e) flameholder means for supporting a flame, said flameholder means positioned at said eductor means inlet, said combustion gas being drawn from the flame on said flameholder means into said eductor means inlet, and means for delivering the mixture of combustion gas, fuel and air to said flameholder means about said eductor means.

2. The burner as claimed in claim 1 wherein said air ducts are offset relative to the longitudinal axis of said housing, said path of said air flowing in said air ducts being non-parallel to the longitudinal axis of said chamber.

3. The burner as claimed in claim 2 wherein said first means is a blower mounted to said housing, said air exiting said ducts creating a suction at the outlet of said passageway and drawing said recirculated combustion gas from the center of said flame into said inlet.

4. A fuel burner comprising:

(a) a housing formed with a central chamber having front, intermediate and rear zones;

(b) means for introducing a liquid fuel into said chamber at said rear zone;

(c) eductor means mounted to said housing in said front zone, said eductor means formed with a passageway having an inlet and an outlet, a plurality of air ducts disposed within said passageway, said air ducts arranged to direct air into said chamber in a path toward the longitudinal axis of said chamber from said forward zone to said rear zone;

(d) means for feeding air into said chamber through said air ducts, said combustion gas drawn into said eductor means inlet by said air passing through said air ducts, said air and said combustion gas being mixed in said intermediate zone, said combustion gas and air entering said forward zone in interleaving streams and mixing in said intermediate zone; and (e) flameholder means mounted to said housing about said eductor means inlet, means for supplying said mixture of combustion gas, air, and fuel from said rear zone to said flameholder means about said eductor means.

5. The fuel burner as claimed in claim 4 wherein said air ducts project into said passageway, said air ducts being offset from the longitudinal axis of said housing.

6. The fuel burner as claimed in claim 5 wherein said combustion gas is drawn through said inlet by said air flowing through said air ducts which creates a suction at said outlet, said combustion gas being drawn from the center of said flameholder means.

7. The fuel burner as claimed in claim 6 wherein said liquid fuel is oil and said combustion gas drawn into said chamber is at a sufficiently high temperature to vaporize said oil sprayed into said rear zone of said chamber, said vaporized oil and combustion gas and air being mixed in said rear zone.

8. The fuel burner as claimed in claim 7 wherein said flameholder means is a screen formed into a dome-shaped structure having a plurality of holes with a diameter in the range of 0.01 of an inch to 0.1 of an inch, said dome-shaped structure substantially surrounding said inlet.

9. A burner comprising:

(a) a housing formed with a central chamber having a front zone, an intermediate zone and a rear zone;

(b) eductor means mounted to said housing at said front zone of said chamber, said eductor means formed with a passageway having an inlet and an outlet, a plurality of ducts disposed within said passageway;

(c) first means for introducing air into said front zone of said chamber through said ducts, said ducts directing air inwardly toward the longitudinal axis of said chamber from said front zone to said rear zone;

(d) second means for drawing combustion gas into said inlet at said front zone of said chamber through said passageway, said combustion gas flowing from said outlet, said combustion gas and said air flowing from said ducts entering said intermediate zone of said chamber in interleaving streams and mixing in said intermediate zone;

(e) third means for introducing fuel into said chamber at said rear zone, said mixture of combustion gas and air mixing with said fuel in said rear zone to form a mixture of combustion gas, fuel, and air;

(f) flameholder means mounted to said housing in front of said eductor means, said flameholder means contiguous with said inlet; and (g) conduit means for guiding said mixture of combustion gas, fuel, and air from said rear zone within said housing to said flameholder means at said front zone.

* * * * *